United States Patent [19]

Lawson et al.

BEST AVAILABLE COPY

[11] 3,995,736

[45] Dec. 7, 1976

[54] COMBINATION SHIPPING PALLET/CONTAINER

[75] Inventors: DeWayne L. Lawson, Mentor, Ky.; Raymond D. Roof, Cincinnati, Ohio

[73] Assignee: Olinkraft, Inc., West Monroe, La.

[22] Filed: May 22, 1975

[21] Appl. No.: 580,117

[52] U.S. Cl. ..... 206/386; 108/51.3; 229/23 A

[51] Int. Cl.[2] ..... B65D 19/00; B65D 19/38

[58] Field of Search ..... 206/386; 108/51, 58; 229/23 R, 23 A

[56] References Cited

UNITED STATES PATENTS

| | | | |
|---|---|---|---|
| 3,568,912 | 3/1971 | Desimas | 206/386 |
| 3,650,459 | 3/1972 | Tucker | 206/386 |
| 3,730,417 | 5/1973 | Lawson | 206/386 |

*Primary Examiner*—William Price
*Assistant Examiner*—Douglas B. Farrow
*Attorney, Agent, or Firm*—Norvell E. Von Behren; Donald W. Marks

[57] ABSTRACT

An improved combination shipping pallet/container for use in conjunction with either a forklift truck or a jack truck and which comprises an outer structure having a plurality of fork receiving openings contained in the lower portion thereof. An inner pallet structure is placed within the outer structure and is retained within the outer structure by retaining means such as staples, glue, or turned in hinged flaps. On top of the inner pallet structure is positioned an inner container structure which, in the preferred embodiment, may be removable from the outer structure. The inner container structure may also be locked to the outer structure by a variety of locking means to thereby provide a much improved combined shipping pallet/container over the prior art.

10 Claims, 25 Drawing Figures

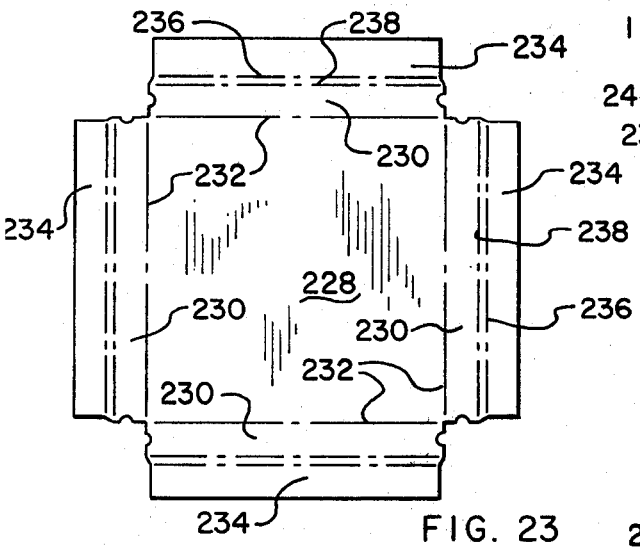
FIG. 23
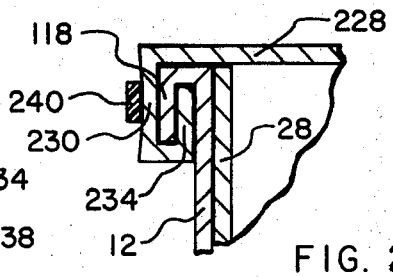
FIG. 24
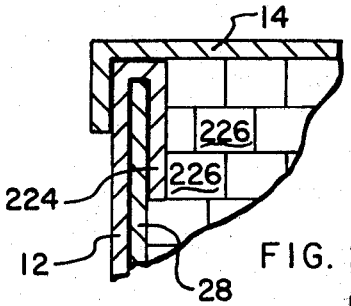
FIG. 22
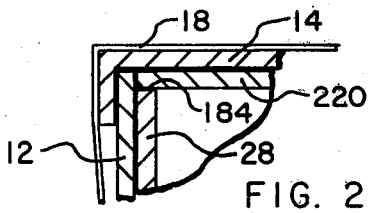
FIG. 21
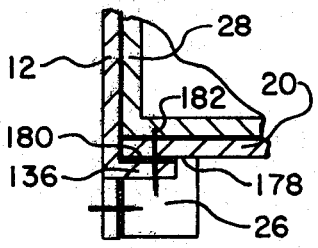
FIG. 12
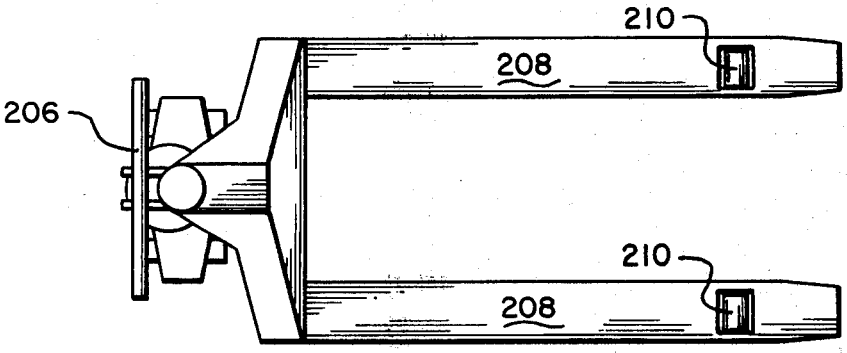
FIG. 15
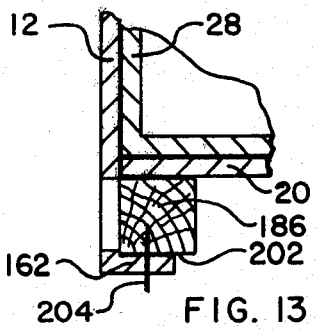
FIG. 13
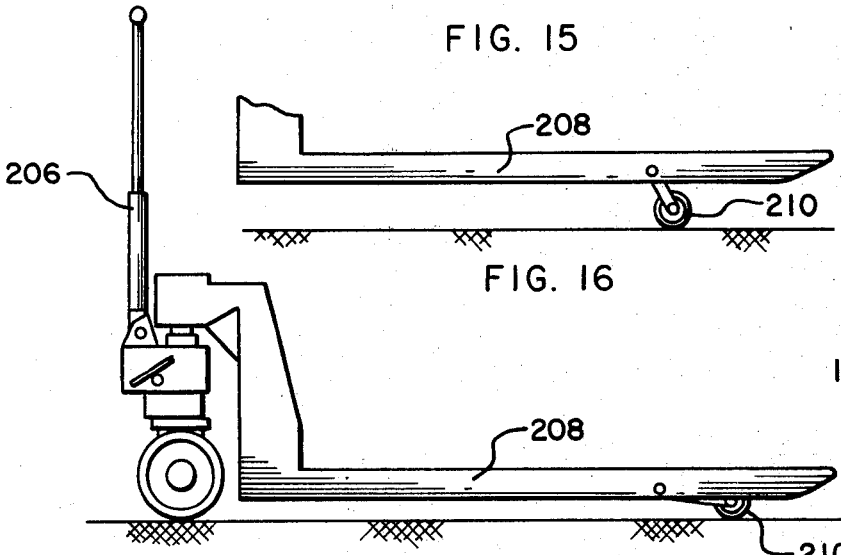
FIG. 16
FIG. 14
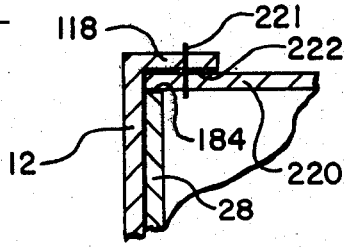
FIG. 25

COMBINATION SHIPPING PALLET/CONTAINER

BACKGROUND OF THE DISCLOSURE

This invention relates to a combination shipping pallet/container and more particularly to an improved shipping pallet/container which may be utilized not only with forklift trucks, but with small hand operated jack trucks commonly used in material handling. The new and improved combination shipping pallet/container contains new and improved means for locking at least a portion of the structures together to provide a more rigid container.

The use of pallets for shipping large quantities of articles which must be stored at their ultimate destination in the shipper's warehouse is, of course, known in the art today. Such prior art pallets were generally made of wood in various configurations and were designed for receiving the forks of a forklift truck which generally was used to convey the loaded pallet from the shipping vehicle to the warehouse of the shipper and/or user of the contents of the pallet.

Since the cost of manufacturing a wooden pallet was often extremely high when compared to the cost of the goods carried on the pallet, various manufacturers have attempted throughout the years to minimize the cost of the pallet structure by providing pallets made of materials less expensive and lighter in weight than the standard type wooden pallets. One such attempt at manufacturing of this nature is taught in the patent to James A. Farrell, U.S. Pat. No. 2,576,715, issued Nov. 27, 1954. In this patent, the inventor attempted to provide an improved pallet by forming it from a fibreboard material which was relatively inexpensive and was shaped into the desired configuration for use as the pallet.

Other attempts at minimizing the cost of palletizing resulted in the evolution of the combination shipping pallet/container which was a container having a pallet structure built either inside the container or outside of the container as one unit. This construction eliminated the use of wooden pallets as had been previously practiced in the art. Many variations of the combination shipping pallet/container were developed for the marketplace and many were successful for the purpose designed.

One type combination shipping pallet/container developed is shown in the U.S. Pat. No. 3,730,417, issued May 1, 1973, to DeWayne L. Lawson. In this original version of a shipping pallet/container, four-way entry was provided in the outer container for use with a standard forklift having a plurality of forks protruding from the front thereof. Such a container, while satisfactory for use with forklift trucks, did not prove to be satisfactory when utilized with the jack trucks which are used in warehouse handling of palletized loads. A jack truck of the type mentioned is shown in the applicant's drawing FIGS. 14–16 and comprise a generally upstanding hand or motor operated jack truck which has two extended fork prongs which are designed to fit into the palletized load. The fork prongs of a jack truck, as compared to a forklift truck, have wheels or rollers positioned in the end thereof which are used to stabilize the fork whenever the load is carried by the wheels of the truck. It can be readily seen that whenever a jack truck is utilized in the shipping pallet/container as shown by the U.S. Pat. No. 3,730,417, the container could not be lifted from the ground since the wheels of the truck in the forward portion of the truck forks would interfere with the lifting of the container by bearing against the bottom of the shipping pallet/container.

In designing the subject improved shipping pallet/container, new and novel means were developed for locking the outer structure of the unit to the inner container structure and also, if desired, to the inner pallet structure.

These novel features of the applicant's improved combination shipping pallet/container are not contained in prior art palletized containers or combination shipping pallet/containers as will now be more fully discussed when referring to the specific prior art patents. For example, the U.S. Pat. No. 3,442,434, issued to J. DeSimas on May 6, 1969, simply teaches an outer container having four-way forklift entry with a plurality of spacers 16, which are glued to a board 15, which is in turn strapped to the bottom 18 of the outer container. This type of container is satisfactory for use with a forklift truck but is not satisfactory for use with the before mentioned type jack trucks and there are no teachings in the patent of the use of an inner container as taught by the applicant's invention used in combination with the new and novel means for locking the inner and outer structures together for the purpose of transmitting the load as will be mentioned more fully hereinafter.

Another prior art type container development is shown in the U.S. Pat. No. 2,540,595, issued to G. P. Props, on Feb. 6, 1951. This container is not a combination shipping pallet/container but is basically a fruit display box or a telescoping box as is known in the trade and which is used for the display of fruits. However, it is noted that no pallet structure is incorporated in this container and no locking together of the structures has been provided by the inventor for the purposes herein described.

Another prior art palletized container structure unit is shown in the U.S. Pat. No. 3,073,500, issued to S. L. Goodrich et al, on Jan. 15, 1963. This patent teaches the use of an inner container which is positioned within an outer container with both of the containers being nailed to a standard wooden pallet which is fastened on the outside of the container. In essence, the Goodrich patent teaches simply a standard type double wall container positioned on top of a standard type wooden pallet which may or may not be nailed to the container since the pallet is not a necessary complement of the invention and may be eliminated as desired.

A further prior art development in the combination shipping pallet/container art is shown in the U.S. Pat. No. 3.666,165, issued to Edward L. Osborne, et al, on May 30, 1972. This invention teaches a composite container and pallet with the pallet being provided from a plurality of tubular members held in a parallel space apart relationship with the tubular pallet structure as shown. The container may be used with forklift trucks but could not be used with jack trucks as has been provided for in the applicant's invention. In addition, the pallet structure of the subject patent is not fastened to the outer container as by glueing or stapling or other means and uniform cross bracing of the structures is not obtained nor is the co-action of the pallet with the inner and outer containers obtained as is taught by the applicant's device and as will be more fully described hereinafter.

A further prior art shipping pallet/container is taught in the U. S. Pat. No. 3,480,196, issued to J. DeSimas on Nov. 25, 1969. This patent, like the first DeSimas patent U.S. Pat. No. 3,442,434, is simply a four-way entry pallet/container which is constructed around an outer container and does not contain the novel features of the inner container co-acting with the outer container which may be utilized with a jack truck as is taught by the applicant's invention.

Another patent issued to DeSimas is the U.S. Pat. No. 3,568,912, issued Mar. 9, 1971, which is a combination shipping pallet/container which may be used with forklift trucks and jack trucks; however, there is not provided in the subject patent any inner container feature as is taught by the applicant's invention with its cross bracing and rigid locked structure hereinbefore mentioned.

Another palletized container of prior art design is shown in the U.S. Pat. No. 3,291,364, issued to J. P. Fischer, on Dec. 13. 1966. This patent, like the Goodrich patent, is simply a known container construction which is positioned on a known type wooden pallet with the container being rigidly fastened to the pallet.

Pallet structures of the known type which are formed of other than wooden materials are shown typically in the U.S. Pat. No. 2,894,671, issued to H. C. Nicholls, on July 14, 1959.

SUMMARY OF THE INVENTION

In order to overcome the problems inherent in the prior art devices and to provide a more improved shipping pallet/container, there is provided by the subject invention an improved combination shipping/container for use in conjunction with either a forklift truck or a jack truck with the combination shipping pallet/container comprising an outer structure having a plurality of pairs of openings formed in the bottom portion, an inner pallet structure positioned in the bottom portion of the outer structure and having formed thereon a plurality of channels for receiving the forks of a forklift truck or a jack truck. The outer structure and the inner pallet structure has means associated therewith for retaining the pallet within the outer structure and the outer structure has an inner container structure positioned within the outer structure and on top of the pallet structure. There is also provided means for locking at least a portion of the structures together for purposes of cross bracing and providing a rigid locked structure.

Accordingly, it is an object of the invention to provide a new and novel combination shipping pallet/container which may be utilized with both a forklift truck and a jack truck.

Another object and advantage of the invention is to provide a new and novel combination shipping pallet/container which contains an inner container structure, an outer structure and an inner pallet structure which may be locked together by a variety of locking means to provide a much improved combination shipping pallet/container.

Still yet another object and advantage of the invention is to provide a new and improved shipping pallet/container which comprises an inner container structure and an outer structure which are rigidly cross-braced and locked together to provide a much improved product.

These and other objects and advantages of the invention will become apparent from a review of the drawings and from a study of the brief description of the preferred embodiment following hereinafter.

BRIEF DESCRIPTION OF THE DRAWINGS

FIG. 12 is a partial enlarged sectional view of the lower left hand corner of FIG. 3 of the drawing showing the pallet structure glued and stapled in position to the outer structure;

FIG. 13 is a partial enlarged sectional view of the lower left corner of FIG. 3 showing a modification of the outer structure stapled to the pallet structure of the subject invention;

FIG. 14 is a side view of a typical jack truck which may be utilized with the subject invention;

FIG. 15 is a top view of the jack truck shown in FIG. 14;

FIG. 16 is a partial side view of the jack truck shown in FIG. 14 showing the forks elevated and the front wheels extened as they would be whenever the jack truck is utilized with the subject invention;

FIG. 20 is a partial enlarged sectional view of the upper left hand corner of FIG. 3 showing still another modification of the basic invention wherein the inner container and the outer structure as well as a top cap are rigidly locked together by means of banding straps;

FIG. 21 is a partial enlarged sectional view of the upper left hand corner of FIG. 3 showing yet another modification of the basic invention wherein there is provided a top pad in combination with a top cap which is banded in place around the structure locking the structures together;

FIG. 22 is a partial enlarged sectional view of the upper left hand corner of FIG. 3 showing another modification of the basic invention wherein there is provided on the outer structure a plurality of inwardly turn flaps which are held in place by the contents of the container;

FIG. 23 is a top view of the production blank of a modified top cap that may be utilized with the subject invention and its modification in FIG. 24;

FIG. 24 is a partial enlarged sectional view of the upper left hand corner of FIG. 3 showing a further modification of the basic invention wherein there is provided a plurality of flaps that are turned outwardly and are banded after being locked to the modified cap structure shown in FIG. 23 of the drawing; and FIG. 25 is a partial enlarged sectional view of the upper left hand corner of FIG. 3 showing another modification of the basic invention wherein there is provided a top pad of the type similar to that shown in FIG. 21 which is glued in place to the outer structure as shown in the drawing.

DESCRIPTION OF THE PREFERRED EMBODIMENT

Figure 1:
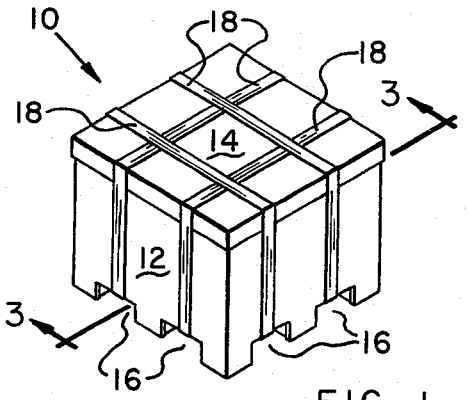
FIG. 1 is a perspective view of the subject combination shipping pallet/container described in the preferred embodiment.
Figure 2:
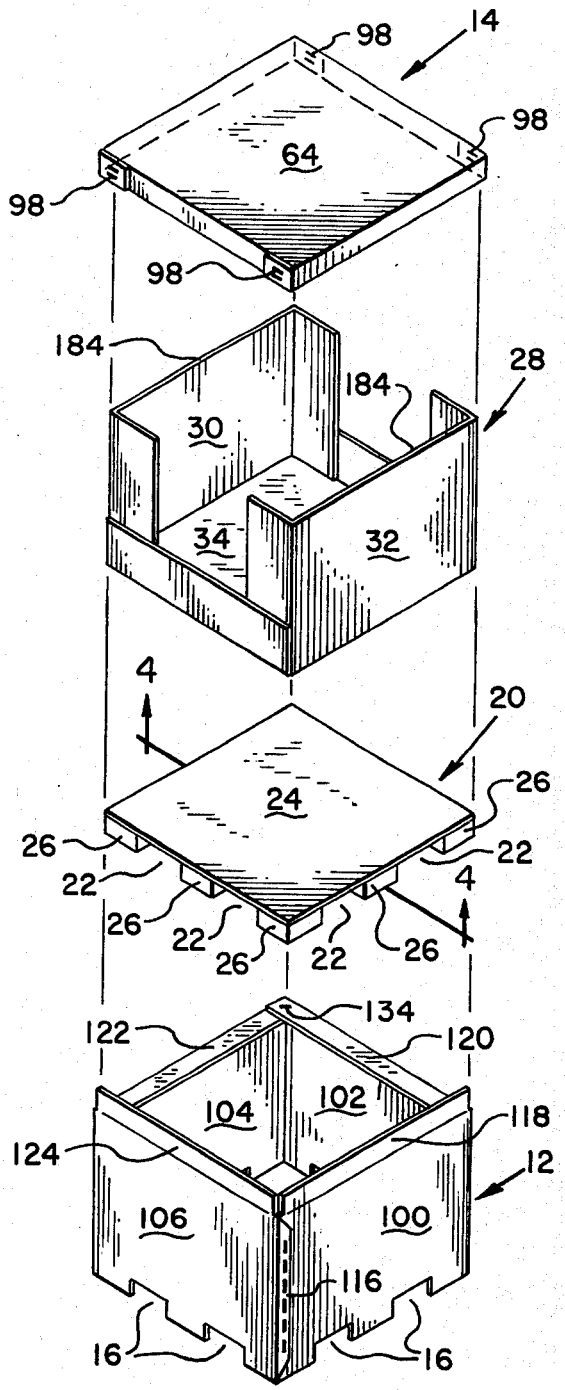
FIG. 2 is an exploded perspective view of the subject combination shipping pallet/container showing the various parts forming the invention.
Figure 3:
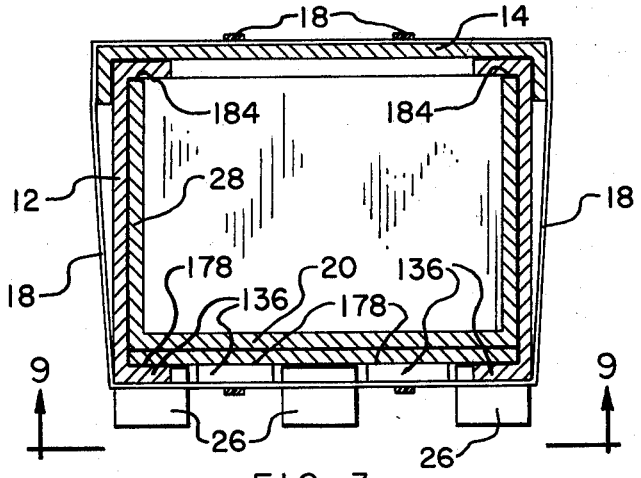
FIG. 3 is a sectional view taken along line 3—3 of FIG. 1 showing the various parts assembled in the preferred embodiment.

Referring now to the drawings in general and in particular to FIGS. 1–3 of the drawing there is shown the subject new and novel improved shipping pallet/container, or shipping container with built-in pallet, indicated generally by the numeral 10 which comprises an outer structure 12 which may have a top cap 14 positioned on the top thereof. the outer structure 12 has a generally open top and bottom portion and has formed in the bottom portion thereof a plurality of pairs of openings 16 which allow four way entry of the forks of a forklift truck or a jack truck. The outer structure 12 may also have a plurality of banding straps 18 positioned around the outer structure and the top cap 14 and within the openings 16 as will be discussed more fully hereinafter.

Figure 4:
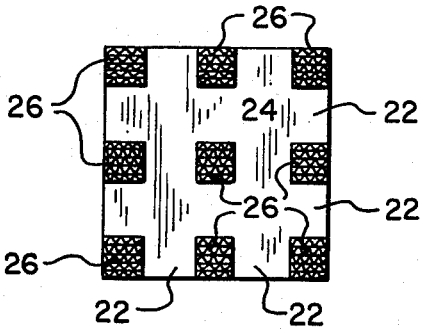
FIG. 4 is a bottom view taken along line 4—4 of FIG. 2 showing the inner pallet structure of the subject invention.

Referring generally to FIG. 2 of the drawing there is shown an exploded perspective view of the subject new and novel shipping pallet/container showing the various structures forming the invention and showing the individual structures which are positioned within the outer structure 12. An inner pallet structure 20 is positioned in the bottom portion of the outer structure 12 and has formed therein a plurality of channels 22 for receiving the forks of the forklift truck or jack truck that may be utilized with the subject invention. The inner pallet structure 20 comprises a top corrugated sheet 24 which has affixed thereto a plurality of individual corrugated paper laminated sheets 26. The sheets 26 are shown in FIG. 4 of the drawing and are laminated together with their flute running in a vertical direction as shown in FIG. 4 of the drawing to form the legs for the inner pallet structure 20. These legs are utilized to form the channels 22 which are positioned with the openings 16 for receiving the forks of the forklift or jack truck.

Figure 9:
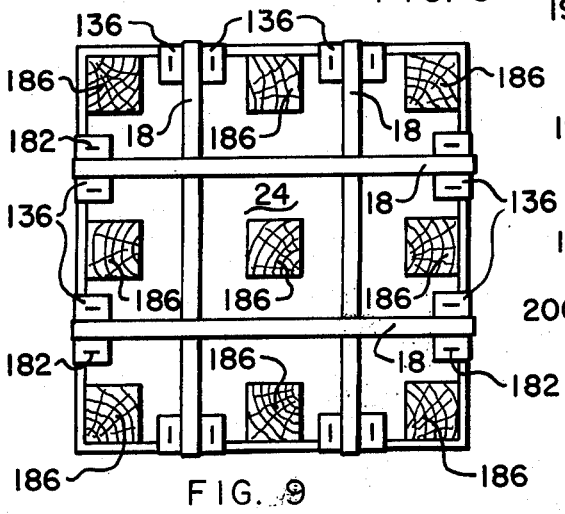
FIG. 9 is a bottom view taken along line 9—9 of FIG. 3 showing the assembled combination shipping pallet/container strapped together by banding straps.

In a modification of the basic invention, the corrugated laminated sheets 26 may be replaced by solid wood blocks 186 as shown in FIG. 9 of the drawings. The inner pallet structure 20 is retained within the outer structure 12 by retaining means which are associated with the outer structure and the pallet structure and which will be described more fully hereinafter.

Figure 6:
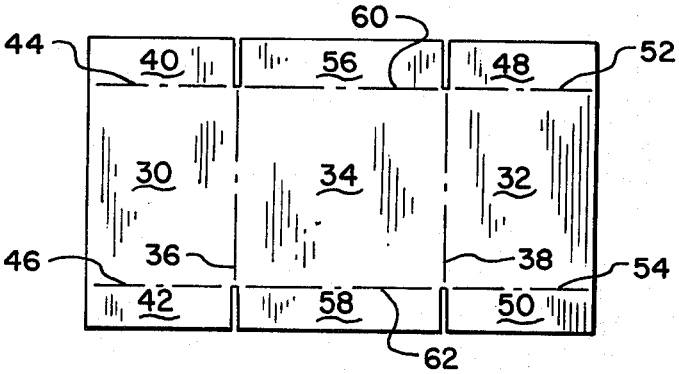
FIG. 6 is a top view of the production blank of the inner container structure of the subject invention.

Positioned on top of the inner pallet structure 20 is an inner container structure 28 which may be removable from the outer structure 12 or may be locked to the outer structure 12 in one of the modifications of the subject invention. The inner container structure 28 may be formed in various configurations and in the preferred embodiment, as shown in FIG. 6 of the drawing, it is formed as a three panel structure comprising a side panel 30 and a side panel 32 hingedly connected to a bottom panel 34 by means of the score lines 36 and 38. The side panel 30 has formed, on the sides thereof, a plurality of side panels 40 and 42 by means of the score lines 44 and 46. In a like manner, the side panel 32 has formed on the sides thereof, a plurality of side panels 48 and 50 by means of the score lines 52 and 54. The bottom panel 34 likewise has a plurality of side panels 56 and 58 formed thereon by means of the score lines 60 and 62.

Figure 5:
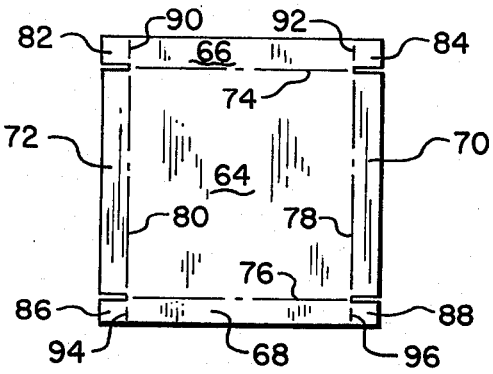
FIG. 5 is a top view of the production blank of the top cap portion of the subject invention.

Referring now to FIG. 5 of the drawing there is shown a top view of the production blank of the top cap portion of the subject invention shown in the preferred embodiment in FIG. 2 of the drawing, and comprises a central panel 64 having a plurality of end panels 66, 68, 70 and 72 hingedly attached thereto by means of the score lines 74, 76, 78 and 80. The end panels 66 and 68 also have hingedly attached thereto a plurality of flaps 82, 84, 86 and 88 by means of the score lines 90, 92, 94, and 96. When folded in the erect position shown in the FIG. 2 of the drawing, the flaps 82 and 86 will be positioned against the end panel 72 and may be stapled or glued in place while the flaps 84 and 88 are positioned against the end panel 70 and may also be stapled or glued in place. In the embodiment shown in FIG. 2 of the drawing the flaps 82, 84, 86 and 88 are shown folded and stapled in place by means of the plurality of staples 98.

Figure 7:
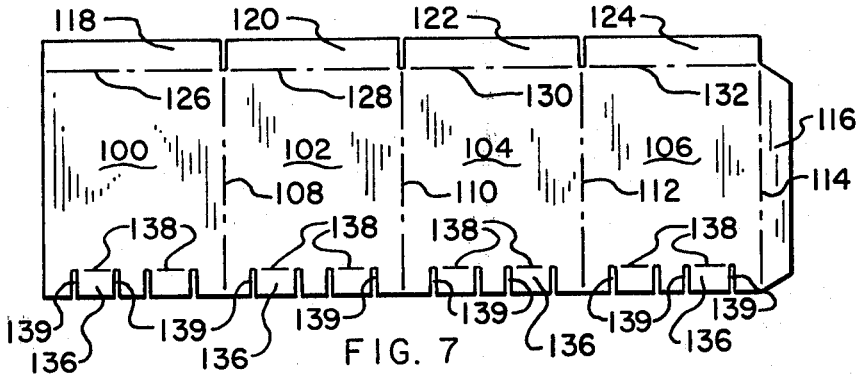
FIG. 7 is a top view of the production blank of the outer structure of the subject invention.
Figure 8:
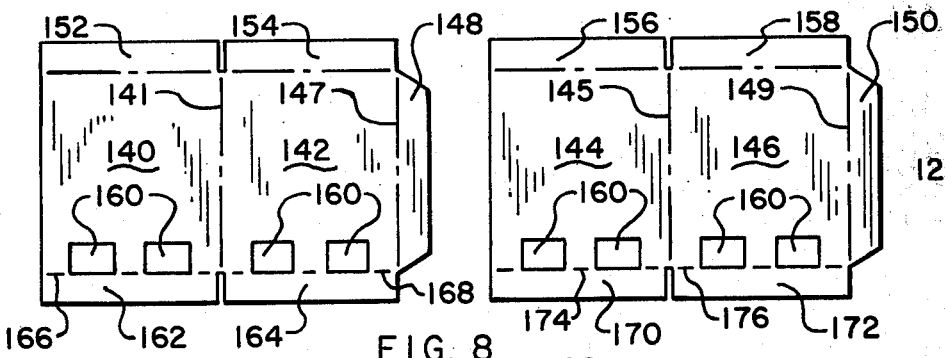
FIG. 8 is a top view of the production blank of a modification of the outer structure of the subject invention showing the structure formed in two pieces.
Figure 2C:
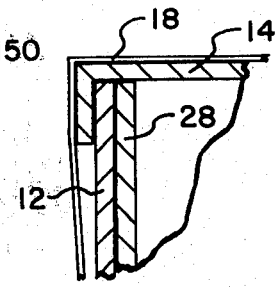

Referring now to FIGS. 2, 7 and 8 of the drawings there will be described in detail the outer structure 12 of the subject invention. By referring particularly to FIG. 7 of the drawing, there is shown a top view of the production blank of the outer structure of the subject invention which comprises a plurality of side panels 100, 102, 104 and 106 which are serially and hingedly connected to each other by means of the score lines 108, 110 and 112. The panel 106 also has hingedly connected to the side thereof, by means of the score line 114, a flap 116 which is positioned against and glued or stapled to the panel 100 to form a manufactured joint for erecting the production blank into the structure shown in FIG. 2 of the drawings. The panels 100, 102, 104 and 106 also have formed on the top portion thereof a plurality of short flaps 118, 120, 122 and 124 which are hingedly connected thereto by means of the score lines 126, 128, 130 and 132. When utilized in the preferred embodiment shown in FIG. 2 of the drawing, the short flaps 118, 120, 122 and 124 may be turned in and stapled together, by means of the plurality of staples 134 as shown in FIG. 2 of the drawing.

Formed on the bottom portion of the panels 100, 102, 104 and 106 are a plurality of tabs 136 which are hingedly connected to the respective panels by means of the score lines 138 and the die cuts 139. The tabs 136 are turned inwardly as shown in FIG. 2 of the drawing to form the openings 16 in the outer structure 12.

Referring now to FIG. 8 of the drawings, there is shown a top view of the production blank of a modification of the outer structure 12 showing the structure formed in two pieces comprising a pair of panels 140 and 142 and a pair of panels 144 and 146. The panel 140 is hingedly connected to the panel 142 by means of the score line 141 while the panel 144 is hingedly connected to the panel 146 by means of the score line 145. The panel 142 has formed thereon a flap 148 which is hingedly connected thereto by means of the score line 147 and which is positioned over the panel 144 forming a manufactured joint to join the two pairs of panels together by glueing or stapling as is known in the art.

In a similar manner, the panel 146 has formed on the side thereof a flap 150 which is hingedly attached thereto by means of the score line 149 and which is positioned over the panel 140 and forms the manufacturing joint for forming the four sided structure shown in FIG. 2 of the drawing. The panel 140 has a short flap 152 formed on the top thereof, while the panel 142 has a short flap 154 also formed on the top. In a like manner, the panels 144 and 146 have short flaps 156 and 158 formed on top thereof by means of the unnumbered score lines shown in FIG. 8 of the drawing.

The modified outer structure shown in FIG. 8 of the drawing has formed on the bottom portion thereof a plurality of cut out openings 160 which form the openings 16 of the outer structure 12 shown in FIG. 2 of the drawing. The openings 160 may also be replaced with hinged tabs similar to the hinged tabs 136 in the FIG. 7 modification within the spirit and scope of the invention. The panels 140 and 142 also have formed on the bottom portion thereof short flaps 162 and 164 which are hingedly connected thereto by means of the score lines 166 and 168. In a similar manner, the panels 144 and 146 have connected thereto a short flap 170 and 172 by means of the score lines 174 and 176.

Referring now to FIG. 3 of the drawing there is shown a sectional view taken along line 3—3 of FIG. 1 showing the various parts assembled in the preferred embodiment. As has been mentioned before, the inner container structure 28 is positioned within the outer structure 12 and on top of the inner pallet structure 20 which has formed on the bottom portion thereof a plurality of corrugated paper laminated sheets 26. When referring to FIG. 3 of the drawing it should be noted that the outer structure 12 utilized in FIG. 3 is the same outer structure shown in FIG. 7 of the drawing, and has formed thereon the plurality of turned in tabs 136 which are positioned against the under side 178 of the inner pallet structure 20.

By referring to FIG. 12 of the drawing, there is shown a partial enlarged sectional view of the lower left hand corner of FIG. 3 of the drawing showing these turned in tabs 136 which may be glued, by means of the glue 180 or may be stapled, by means of the staples 182 to the under side 178 of the inner pallet structure 20 thereby retaining the pallet structure 20 within the outer structure 12. The inner pallet structure 20 may also be retained within the outer structure 12 by means of the banding straps 18 which are positioned around the container as shown in FIG. 1 and 3 of the drawings and which serve to retain the inner pallet structure 20 from dropping out of the bottom of the outer structure 12 whenever the tabs 136 are turned in as shown in FIG. 3 and 12 of the drawings.

By referring now to the upper portion of FIG. 3 there will be described the means for locking together at least a portion of the structures so that a much improved container is provided which is rigidly cross-braced and locked together adding great structural stability and rigidity to the container proper. The inner container structure 28 may be removable from the outer structure 12 and when properly designed would have its upstanding side panels 30 and 32 formed in such a manner that the top edge 184 would bear against the short flaps 118, 120, 122 and 124 formed on the upper portion of the outer container structure 12. As has been mentioned before, the short flaps may be locked together by the plurality of staples 134 as shown in FIG. 2 of the drawing and there is thereby provided a rigidly locked container in which the inner container structure 28 and the outer structure 12 may be moved together as a unit whenever the forks of a forklift or a jack truck are inserted into the openings 16 to lift the container from the floor where it has been positioned.

To further enhance the unity of the package, whenever the top cap 14 is positioned over the outer structure 12 as shown in FIG. 3 of the drawing and has the plurality of banding straps 18 applied thereto, there is provided an extremely tight and unitary package which may be lifted with ease by the forklift truck or the jack truck without destroying any one portion of the package. The turned in tabs 136 also serve as a pad to reinforce the lower corners of the container whenever the banding straps 18 are tightly applied to the package after it has been filled by the packer.

Figure 10:
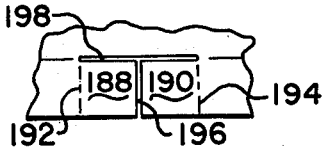
FIG. 10 is a partial side view of the bottom portion of the outer structure showing a modification of the hinged tabs formed on the outer structure as shown in FIG. 7 of the drawing.
Figure 11:
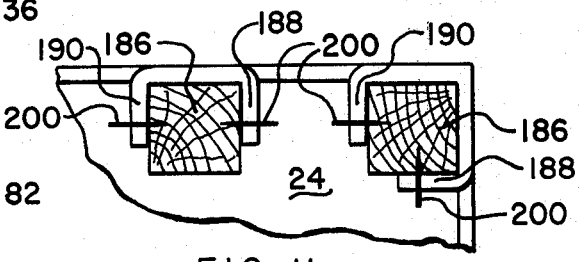
FIG. 11 is a partial bottom view similar to the view shown in FIG. 9 of the drawing showing the modified hinged tabs shown in FIG. 10 of the drawing positioned for assembly.

Referring now to FIGS. 9–11 there are shown modifications of the basic invention which may be utilized as desired by the customer. In the modification of FIG. 9, it should be noted that the corrugated laminated paper sheets 26 have been replaced by solid wooden blocks 186 which may be glued to the top sheet 24 in a manner similar to which the corrugated paper laminated sheets 26 were glued to the top sheet 24. It can also be seen in FIG. 9 of the drawing how the tabs 136 of the outer structure 12 are turned inwardly and may be stapled or glued in place to the top sheet 24. In the modification shown in FIG. 9 of the drawing the tabs 136 are stapled in place by means of the staples 182 and serve to reinforce the corner bottom portion of the outer structure 12 where the banding straps 18 are positioned tightly around the combination shipping pallet/container.

By referring to FIG. 10 and 11 of the drawing, there is seen another modification of the basic invention wherein each tab 136 is replaced by two tabs 188 and 190 which are hingedly connected to the bottom portion of the outer structure 12 by means of the score lines 192 and 194 and the die cut 196 in combination with the die cut 198. When formed in this manner, the modified hinged tabs 188 and 190 pivot horizontally about the vertical hinge formed by means of the score line 192 and 194 and are positioned around the solid wood blocks 186 as shown in FIG. 11 of the drawing. Thereupon they may be either glued to the blocks 186 or may be stapled to the blocks as shown in FIG. 11 by means of the staples 200. From this it can be seen that the modified hinged tabs 188 and 190 function in a manner similar to the hinged tabs 136 and serve as a means for retaining the pallet structure 20 within the outer structure 12.

Referring to FIG. 13 of the drawing there is shown a partial enlarged sectional view of the lower left hand corner of FIG. 3 showing the modified outer structure 12 shown in FIG. 8 of the drawing and how the inner pallet structure 20 will be retained within the outer structure 12. It can be seen in FIG. 13 of the drawing that the plurality of flaps such as flap 162 would be turned inwardly and would be positioned on the bottom surface 202 of the wooden block 186 or the corrugated paper laminated sheet 26 of the type shown in FIG. 4. In order to retain the pallet structure 20 within the outer structure 12, the flaps 162, 164, 170 and 172 would be either glued to the wooden blocks 186 or would be stapled in place as is shown in FIG. 13 of the drawing by means of a plurality of staples 204.

In utilizing either the preferred embodiment container having an outer structure 12 similar to that shown in FIG. 7 or a modified outer structure 12 similar to that shown in FIG. 8 of the drawing, it can be readily seen that either structure may be utilized with both standard forklift trucks and also jack trucks of the type shown in FIGS. 14–16 of the drawings. The jack truck of the type mentioned comprises a generally upstanding motor operated section 206 which has two extended fork prongs 208 which are designed to fit into the palletized load within the channels 22 formed in the bottom of the inner pallet structure 20. It should be noted that the fork of the jack truck k, as compared to the fork of a forklift truck, generally have wheels or rollers 210 which are positioned in the end of the prongs 208 and which are used to stabilize the fork whenever the load is carried by the wheels of the jack truck. With the utilization of jack trucks for handling cargo, it can be seen that the outer structure 12 of the subject invention is required to have an open bottom of the type shown in either FIG. 12 of the drawing or FIG. 13 of the drawing or some other modified open bottom which would allow the container to be raised up on the fork of the jack truck without the wheels or rollers 210 bearing against the bottom of the container as it is lifted.

Referring now to FIGS. 17–25 there are shown modifications of the basic invention shown in FIG. 3 of the drawing wherein the means for locking together at least a portion of the various structures is shown in the various modifications. FIGS. 17–22 and FIGS. 24–25 are partial enlarged sectional views of the upper left hand corner of FIG. 3 showing the various modifications over the basic design embodiment in FIG. 3.

Figure 17:
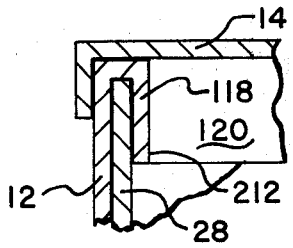
FIG. 17 is a partial enlarged sectional view of the upper left hand corner of FIG. 3 showing a modification of the subject invention wherein there is provided short flaps which are turned inwardly and downwardly and are wedged in place.

In the modification shown in FIG. 17 of the drawing the outer structure 12 would be formed with a plurality of short flaps 118, 120, 122 and 124 as shown in FIG. 7 of the drawing and the short flaps would be turned inwardly and downwardly within the inner container structure 28 and would be wedged in place with each other instead of being stapled as shown in FIG. 2. That is to say for example, the short flap 120 along the line 212 as shown in the FIG. 17. When wedged in this manner, it can be readily seen that the inner container structure 28 and the outer structure 12 are rigidly locked together by means of the turned in flaps 118 and 120 and are restrained from relative motion whenever the container structure is raised by the forks of the forklift truck or the jack truck.

Figure 18:
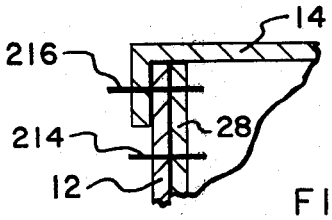
FIG. 18 is a partial enlarged sectional view of the upper left hand corner of FIG. 3 showing a further modification of the invention wherein the inner container and the outer structure are locked in place by a plurality of staples.

Referring now to FIG. 18 of the drawing there is shown still another modification of the basic invention wherein the inner container structure 28 is locked to the outer structure 12 by means of a plurality of staples 214 and may also be locked to the top cap 14 by a plurality of staples 216. The staples 214 and 216 may be placed around the periphery of the top cap. In this modification, the short flaps 118, 120, 122 and 124 have been omitted from the outer structure 12.

Figure 19:
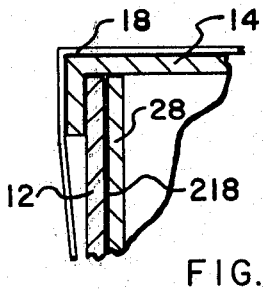
FIG. 19 is a partial enlarged sectional view of the upper left hand corner of FIG. 3 showing another modification of the basic invention wherein the inner container structure is locked to the outer structure by means of an adhesive and there is also provided a top cap which is banded in place around the structures.

FIG. 19 shows still another modification of the basic invention wherein the inner container structure 28 is locked to the outer structure 12 by means of an adhesive 218 which may be placed between the respective structures by means well-known in the art. In addition, the top cap 14 may be locked to both of these structures by means of a plurality of banding straps 18 as shown in FIG. 1 of the drawing and as also shown in FIG. 19. This modification also has the short flaps 118, 120, 122 and 124 omitted therefrom.

Referring to FIG. 20 of the drawing there is shown a modification of the FIG. 19 version wherein the inner container structure 28 and the outer structure 12 are locked together simply by means of the top cap 14 being positioned over these structures and by positioning a plurality of banding straps 18 around the container. In this modification, the plurality of short flaps 118, 120, 122 and 124 would be eliminated from the outer structure 12.

Referring to FIG. 21 of the drawing there is shown a further modification of the basic invention wherein a top pad 220 is positioned on the upper edge 184 of the inner container structure 28 which also has the short flaps 118, 120, 122 and 124 omitted from the outer structure. Thereafter the top cap 14 is positioned over the outer structure 12 and on top of the top pad 220 and is banded by means of a plurality of banding straps 18.

In the modification shown in FIG. 25 of the drawings, a top pad 220 is also positioned over the upper edge 184 of the inner container structure 28 whereafter the short flaps 118, 120, 122 and 124 of the outer structure 12 are folded over horizontally and are glued to the top pad 220 by means of the adhesive 222. The short flaps 118, 120, 122 and 124 may also be stapled, by staples 221, to the top pad in place of the adhesive 222. In this modification it may be desirable to also provide a top cap 14 over the outer structure which may or may not be banded in place as desired by the ultimate customer.

Referring now to FIG. 22 of the drawing, there is shown still another modification of the basic invention wherein the outer structure 12 is formed with a plurality of longer top flaps 224 which are turned inwardly and are then turned downwardly within the container structure into juxtaposition with the inner container structure 28 and are held in place by the contents 226 of the box with which are tightly positioned within the container. A top cap 14 may then be applied to the pallet container and a plurality of banding straps may also be applied if desired or the top cap may be stapled or glued in place.

By referring to FIGS. 23 and 24 of the drawing there is shown yet another modification of the basic invention wherein a modified top cap 228 is provided and is locked to the outer structure 12 as is shown in FIG. 24 of the drawing. The modified top cap 28 has a plurality of inner flaps 230 hingedly attached to the top cap panel by means of the score lines 232. In addition, each inner flap 230 has an outer flap 234 hingedly attached thereto by means of the double score lines 236 and 238. By referring to FIG. 24 of the drawing, there is shown how this modified top cap 228 is locked to the outer structure 12 which has a plurality of short top flaps 118, 120, 122 and 124 form thereon and which are turned outwardly and downwardly as shown in FIG. 24. The outer flaps 234 are placed in juxtaposition with the turned down short flaps 118, 120, 122 and 124 and the entire modified top cap 228 is then banded in place by means of the banding strap 240 to provide a tight locking of the inner container structure 28 to the outer structure 12.

From the foregoing it can be seen that there has been provided a much improved shipping pallet/container which may be utilized in conjunction with forklift truck and a jack truck and which has improved means formed thereon for retaining the inner pallet structure 20 within the outer structure 12 and also has novel means for locking together at least a portion of the structures to the inner container structure in such a manner as to provide a rigid cross-braced structure which is locked together from relative motion between the structures thereby providing a much improved container that is able to handle severe operational handling without damage to the pallet/container or the contents positioned within the container. The outer structure 12 as well as the inner pallet structure 20 and the inner container structure 28 along with the top caps 14 and 228 may all be formed of corrugated paper of the type well-known in the art and also may be formed of other materials within the spirit and scope of the invention. The banding straps 18 may be formed of a plastic or a steel material and also may be formed of other materials within the spirit and scope of the invention. As has been before described, a portion of the inner pallet structure 20 may be also formed of solid wooden blocks 186 in place of the corrugated paper sheets 26 shown in FIG. 4 of the drawing.

Since the thickness and dimensions of the paperboard container may be varied to suit the loading conditions encountered, the combination pallet/container may be stacked as high as desired with complete safety, within normal material handling conditions. By the use of the subject invention the replacement cost of metal drums, wooden pallets, increase in storage space and other factors is greatly decreased thereby resulting in the savings of many dollars and cents of shipping costs for the articles enclosed within the container.

While the present invention has been described and illustrated by reference to the preferred embodiment, it will be readily apparent that the invention lends itself to various modifications which would be obvious to those skilled in the art. Accordingly, reference should be made solely to the attached claims to determine the scope of the invention.

Having described our invention, we claim:

1. An improved shipping container with built-in pallet for use in conjunction with pairs of fork prongs of both a forklift truck and a jack truck, the container comprising:

a. an outer container structure having a plurality of serially joined side panels, an open bottom, and pairs of side openings formed in the bottom portions of each of the side panels for receiving a pair of truck fork prongs, said side openings each having an upper horizontal edge and two opposite vertical side edges;

b. an inner pallet structure positioned within the bottom portion of the outer container structure and having a top sheet and a plurality of legs attached to the bottom of the top sheet, said legs arranged to form open channels on the bottom of the pallet structure aligned with the side openings of the outer container for receiving the pair of fork prongs;

c. said outer container having tabs hinged on the upper edges of the side openings and bent underneath the top sheet of the pallet structure;

d. an inner container structure positioned within the outer container structure and on top of the pallet structure; and e. means securing the tabs to the bottom of the top sheet and securing the inner container structure to the outer container structure.

2. A shipping container as claimed in claim 1 wherein said securing means includes a glue.

3. A shipping container as claimed in claim 1 wherein said securing means includes a plurality of staples.

4. A shipping container as claimed in claim 1 wherein said inner container structure has a plurality of side panels extending to the top of the side panels of the outer container structure, and the securing means includes a top means engaging the upper edges of the side panels of the inner container structure.

5. A shipping container as claimed in claim 4 wherein said securing means also includes a plurality of straps each passing over the top means, on opposite sides of the outer container structure, and under respective tabs and the pallet structure through a respective one of the channels.

6. A shipping container as claimed in claim 1 wherein the inner container structure has a plurality of side panels extending to the top of the side panels of the outer container structure, and the securing means includes a plurality of short top flaps of the outer container structure hinged on the top edges of the side panels of the outer container structure and bent over the top edges of the side panels of the inner container structure.

7. A shipping container as claimed in claim 6 wherein the short top flaps are secured together in a horizontal position.

8. A shipping container as claimed in claim 6 wherein the short top flaps are bent downward along the inside of the inner container structure.

9. A shipping container as claimed in claim 1 wherein the legs are blocks of wood.

10. A shipping container as claimed in claim 1 wherein the legs are blocks formed by laminating a plurality of layers of corrugated paperboard together.

* * * * *

UNITED STATES PATENT OFFICE
CERTIFICATE OF CORRECTION

PATENT NO. : 3,995,736

DATED : December 7, 1976

INVENTOR(S) : DeWayne L. Lawson, Raymond D. Roof

It is certified that error appears in the above-identified patent and that said Letters Patent are hereby corrected as shown below:

Column 1, Line 32, omit "1954" and insert in place thereof -- 1951 --.

Column 2, Line 1, omit the word "forks", insert in place thereof -- fork --.

Column 3, Line 20, after Dec. 13 delete "."and insert in place thereof -- , --.

Column 4, Line 51, delete "extened" and insert in place thereof -- extended --.

Column 5, Line 42, delete "the" in the second occurrence and insert in place thereof -- The --.

Column 9, Line 59, after the word "flap" insert the following -- 118 would be wedged in place withe the short flap --.

Signed and Sealed this

Fifteenth Day of February 1977

[SEAL]

*Attest:*

RUTH C. MASON
*Attesting Officer*

C. MARSHALL DANN
*Commissioner of Patents and Trademarks*